US007134621B2

(12) United States Patent
Choi et al.

(10) Patent No.: US 7,134,621 B2
(45) Date of Patent: Nov. 14, 2006

(54) MIXING APPARATUS

(76) Inventors: Woon Seung Choi, 201, Kumho Villa, 56-164, Chulsan-1dong, Kwangmyung, Kyunggido (KR) 423-031; Woo Ram Choi, 201, Kumho Villa, 56-164, Chulsan-1dong, Kwangmyung, Kyunggido (KR) 423-031

( * ) Notice: Subject to any disclaimer, the term of this patent is extended or adjusted under 35 U.S.C. 154(b) by 86 days.

(21) Appl. No.: 10/483,257

(22) PCT Filed: Jul. 19, 2002

(86) PCT No.: PCT/KR02/01358

§ 371 (c)(1),
(2), (4) Date: Jan. 13, 2004

(87) PCT Pub. No.: WO03/013711

PCT Pub. Date: Feb. 20, 2003

(65) Prior Publication Data

US 2004/0170084 A1 Sep. 2, 2004

(30) Foreign Application Priority Data

Jul. 20, 2001 (KR) ..... 2001-43643

(51) Int. Cl.
*B01F 3/08* (2006.01)
*B01F 3/06* (2006.01)

(52) U.S. Cl. ..... 241/46.06; 241/46.01; 241/261.2; 241/296; 366/293; 366/317; 366/340

(58) Field of Classification Search ..... 241/46.06, 241/261.2, 244, 260, 296; 366/293, 317, 366/340

See application file for complete search history.

(56) References Cited

U.S. PATENT DOCUMENTS

| | | | | |
|---|---|---|---|---|
| 1,265,964 | A * | 5/1918 | Schaffer | 422/162 |
| 3,845,938 | A * | 11/1974 | Schold | 366/144 |
| 4,175,873 | A | 11/1979 | Iwako et al. | |
| 4,439,042 | A * | 3/1984 | Bertoglio | 366/154.2 |
| 4,915,509 | A * | 4/1990 | Sauer et al. | 366/171.1 |
| 5,399,015 | A | 3/1995 | Zhi-Qiang et al. | |
| 6,149,293 | A | 11/2000 | Pavese | |
| 6,193,408 | B1 * | 2/2001 | Miura et al. | 366/304 |
| 6,241,377 | B1 * | 6/2001 | Heyde | 366/147 |
| 6,502,980 | B1 * | 1/2003 | Ekstrom et al. | 366/305 |

* cited by examiner

*Primary Examiner*—Henry Bennett
*Assistant Examiner*—Jason Y. Pahng
(74) *Attorney, Agent, or Firm*—Bacon & Thomas, PLLC

(57) ABSTRACT

A mixing apparatus wherein raw material may be crushed to fine particles of desirous size to be mixed uniformally by multi-layered mixing blocks. The mixing apparatus includes a plurality of mixing units piled up in a housing, and arrays of projections formed at the facing side of the mixing units and located alternately in order to form concentric circles which are not interfered with each other. The mixing units are formed with first and second pairs of upper and lower disks. The arrays of the projections are formed on the outer surface of the pairs of disks, and the fluid passages are formed between the upper and lower disks. The inflow passages are opened to the fluid passages which are formed between the lower disks of each pair and the housing. The outflow passages are formed at the inner surface of the upper disks of each pair and the mixing units are attachable in multiple layers.

5 Claims, 16 Drawing Sheets

MIXING APPARATUS

FIELD OF THE INVENTION

The invention relates to a mixing apparatus, and more particularly to a mixing apparatus wherein raw material is crushed to fine particles of desirous size and mixed uniformly by multi-layed mixing blocks which are additionally attachable, the cost is decreased because more emulsifier or other additional treatment is not required, the efficiency of crushing and mixing is increased because the movement of raw material and the collision between the crushed particles are increased, and the capacity may be increased easily.

BACKGROUND OF THE INVENTION

Conventionally, emulsion fuel is known as the fuel that water and oil which are crushed to fine particles and mixed each other. And, in order to increase fuel combustion efficiency, the emulsion fuel has been used for a large-sized boiler or a ship engine and the like. And, various kinds of mixing apparatuses have been invented for making the emulsion fuel. Further, the above mixing apparatuses are used in order to crush various kinds of fluids finely and to mix them uniformly. And, the fuel which are crushed and mixed like this are used in a factory and the like.

The above prior mixing apparatus includes a single rotation unit which is mounted in a case and is rotated by a motor, and a fixing unit which is mounted in the case parallel to the rotation unit. Here, at the facing side of the rotation unit and the fixing unit, a plurality of projections are formed along the circumferential direction at a predetermined interval so that they form concentric circles which are alternately engaged with each other.

Accordingly, if a fluid, that is, a raw material is supplied in the center of the rotation unit which is rotating at a high speed, the liquid is rotated along the projections of the rotation unit so that it passes the spaces between the respective projections owing to centrifugal force and is outwardly discharged through the discharge holes formed at the periphery of the case. Then, the liquid alternately passes the respective arrays of the projections of the rotation unit and the fixing unit so that it continuously collides with the respective projections. Accordingly, the fluid is crushed to fine particles and mixed together so that it is emulsified in fine particles.

However, the mixing apparatus has the problem that, if the fluid supplied in its center passes between the rotation unit and the fixing unit, because it is rapidly discharged through the discharge holes of the case or is discharged toward the outside through a centrifugal vane, the fluid may not be crushed to particles of desirous size. Accordingly, the mixing apparatus has the problem that much troubles may be caused and much time is wasted because the user stores the emulsified fluid in a tank and emulsifies the fluid once again in order to crush the fluid to desirous size. Further, the mixing apparatus has the problem that additional equipments are increased and the emulsified material may be separated each other and returned to the original state while it is stored in the tank.

Accordingly, in case of emulsifying the fluid by the prior mixing apparatus, an emulsifier like a surface active agent is usually mixed into the fluids in order that the supplied fluids may be mixed uniformly and the mixed fluids may not be easily separated each other. However, the emulsification method like the above has the problems that the cost is increased and the environment is polluted because an emulsifier like a surface active agent may be additionally required besides pure fuel or raw material, and the emulsion fuel may be separated into water and oil while preheating the fuel.

And, the fluid supplied into said mixing apparatus is rotated along the rotation unit in the spaces between the projections of the rotation unit so that it flows outwardly because of centrifugal force at the moment that the spaces between the projections of the rotation unit are opened to the spaces between the projections of the fixing unit. Here, while said fluid is going to flow toward the tangential direction of the rotation unit because of centrifugal force, the spaces between the projections of the fixing unit filled with said fluids may radially form the rectangular spaces which are different angle from the flowing direction of the fluids. Accordingly, the fluid flown in the rectangular space may be resisted in its acceleration movement, and the emulsification efficiency may be remarkably decreased.

Further, because the respective projections of the mixing apparatus are made by forming a plurality of concentric ring type protrusions on one surface of a disk and by slitting said protrusions toward the radial direction, the size of the projections grows larger toward the outer side of the radial direction. Accordingly, the mixing apparatus has the problem that the efficiency of crushing and mixing is decrease remarkably when the fuel passes the spaces between the projections so that the capacity may not be easily increased.

SUMMARY OF THE INVENTION

The invention is created to solve the above described problems and so the object of the invention is to provide a mixing apparatus wherein raw material may be crushed to fine particles of desirous size to be mixed uniformally by multi-layed mixing blocks which may be additionally attachable, the cost may be decreased because more emulsifier or other additional treatment is not required, the effect of crushing and mixing may be increases because the movement of raw material and the collision between the crushed particles may be increased, and the capacity may be increased easily.

According to a first aspect of the invention, there is provided with a mixing apparatus wherein a plurality of mixing units 104, 106 are piled up in a housing 114 which has an inlet 118 and an outlet 112, the mixing units 104, 106 are relatively rotated by a motor 10, arrays of projections 27, 28 are formed at the facing side of the mixing units 104, 106, said arrays are formed with a plurality of projections 27, 28 which are arrayed along the circumferential direction in a predetermined space, the arrays of the projections 27, 28 are located alternately in order to form concentric circles which are not interfered with each other;

wherein said respective mixing units 104, 106 are formed with the pairs of disks 34, 36, 44, 46 which are parallel arrayed in a predetermined space, the arrays of the projections 27, 28 are formed on the outer surface of the disks 34, 36, 44, 46, fluid passages 39, 49 are formed between the disks 34, 36, 44, 46, a predetermined space is formed between the outer surface of the respective disks 34, 44 directed to the inlet 118 of the housing 114 and the inner surface of the housing 114 so that the inflow passages 37, 47 which are opened to the fluid passages 39, 49 are formed between the disks 34, 44 and the housing 114, the outflow passages 35, 45 which are opened to the fluid passages 39, 49 are formed at the inner surface of the disks 36, 46 directed to the outlet 112 of the housing 114, and the mixing units 104, 106 are attachable in multiple layers.

According to a second aspect of the invention, there is provided with a mixing apparatus of said first aspect wherein both sides of the projections 27, 28 of said mixing units 104, 106 are formed with concave curve surface.

According to a third aspect of the invention, there is provided with a mixing apparatus of said first aspect wherein the housing 114 includes lower housing 24 which has an inlet 118 to supply the fluid into the center of the mixing units 104, 106, one or more of intermediate housings 40 which are connected to the lower housing 24 and has mixing space 41 to accommodate the mixing units 104, 106, and upper housing 51 which is connected to the intermediate housing 40 and has an outlet 112 which is opened to the mixing space 41 of the intermediate housing 40, and wherein the intermediate housing 40 is attachable in multiple layers so that the mixing space 41 to accommodate the mixing units 104, 106 may be attachable additionally.

According to a fourth aspect of the invention, there is provided with a mixing apparatus of said first aspect wherein a plurality of mixing units 104, 106 are divided into rotation unit 104 and fixing unit 106, a combination hole 105 is formed at the center of the rotation unit 104, the shaft 102 of a motor 100 is inserted into the combination hole 105, the fixing unit 106 is fixed to the inner surface of the housing 40, and an insertion hole 107 is formed at the center of the fixing unit and the shaft 102 is slidably combined in the insertion hole 107.

According to a fifth aspect of the invention, there is provided with a mixing apparatus of said fourth aspect wherein one or more of fluid guide blades which are slanted radially are mounted at the fluid passage 39 in the rotation unit 104, one or more of fluid guide blades 63 slanted to the direction which is opposite to that of the fluid guide blades 62 are mounted at the fluid passage 49 of the fixing unit 106, and the fluid which passes the fluid passages 39, 49 may be guided to flow in the inner side by said fluid guide blades 62, 63.

According to a sixth aspect of the invention, there is provided with a mixing apparatus of said first aspect wherein a plurality of slots 45 parallel to the shaft 102 are formed at the inner circular surface of the mixing space 41 of the housing 114.

According to a seventh aspect of the invention, there is provided with a mixing apparatus of said first aspect wherein disk members 108, 110 having the arrays of a plurality of projections 25, 26 at one side are mounted in the inner space between the inlet 118 side and the outlet 112 side of the housing 114, the arrays of the projections 25, 26 are located alternately with the arrays of the projections 27, 28 of the adjacent mixing blocks 104, 106, and the disk members 108, 110 and the mixing blocks 104, 106 are relatively rotated.

According to a eighth aspect of the invention, there is provided with a mixing apparatus wherein a plurality of mixing units are mounted in a housing 114 which has an inlet 118 and an outlet 112, the mixing units are relatively rotated by a motor 10, arrays of projections are formed at the facing side of the mixing units, the arrays of the projections are formed with a plurality of projections which are arrayed along the circumferential direction in a predetermined space, the arrays of the projections are located alternately in order to form concentric circles which are not interfered with each other;

wherein both sides of the projections 27, 28 of said mixing units 104, 106 are formed with concave curve surface and the fluid which passes the spaces 27*a*, 28*a* between the adjacent projections 27, 28 may be turned along the concave curve surface.

According to a ninth aspect of the invention, there is provided with a mixing apparatus of said eighth aspect wherein a plurality of mixing units 104, 106 are divided into rotation unit 104 and fixing unit 106, the rotation unit 104 includes a disk 34, the arrays of the projections 28 formed on one side of the disk 34, and one or more of fluid guide blades 62 formed on another side of the disk 34 at a predetermined radial slanting angle, and the fluid which passes between the arrays of the projections 28 and is supplied to the periphery of the rotation disk 104 may be guided to the center of the housing 114 by the fluid guide blades 62.

According to a tenth aspect of the invention, there is provided with a mixing apparatus wherein a plurality of mixing units are piled up in a housing 114 which has an inlet 118 and an outlet 112, the mixing units are relatively rotated by a motor 10, arrays of projections are formed at the facing side of the mixing units, the arrays of the projections are formed with a plurality of projections which are arrayed along the circumferential direction in a predetermined space, the arrays of the projections are located alternately in order to form concentric circles which are not interfered with each other;

wherein a plurality of mixing units 104, 106 are divided into rotation unit 104 and fixing unit 106, the rotation unit 104 includes a disk 34, the arrays of the projections 28 formed on one side of the disk 34, one or more of fluid guide blades 62 formed on another side of the disk 34, the fluid guide blades 62 are slanted to radial direction, and the fluid which passes the arrays of the projections 28 and is supplied to the periphery of the rotation disk 104 may be guided toward the center of the housing 114 by the fluid guide blade 62.

DETAILED DESCRIPTION OF THE INVENTION

Figure 1:
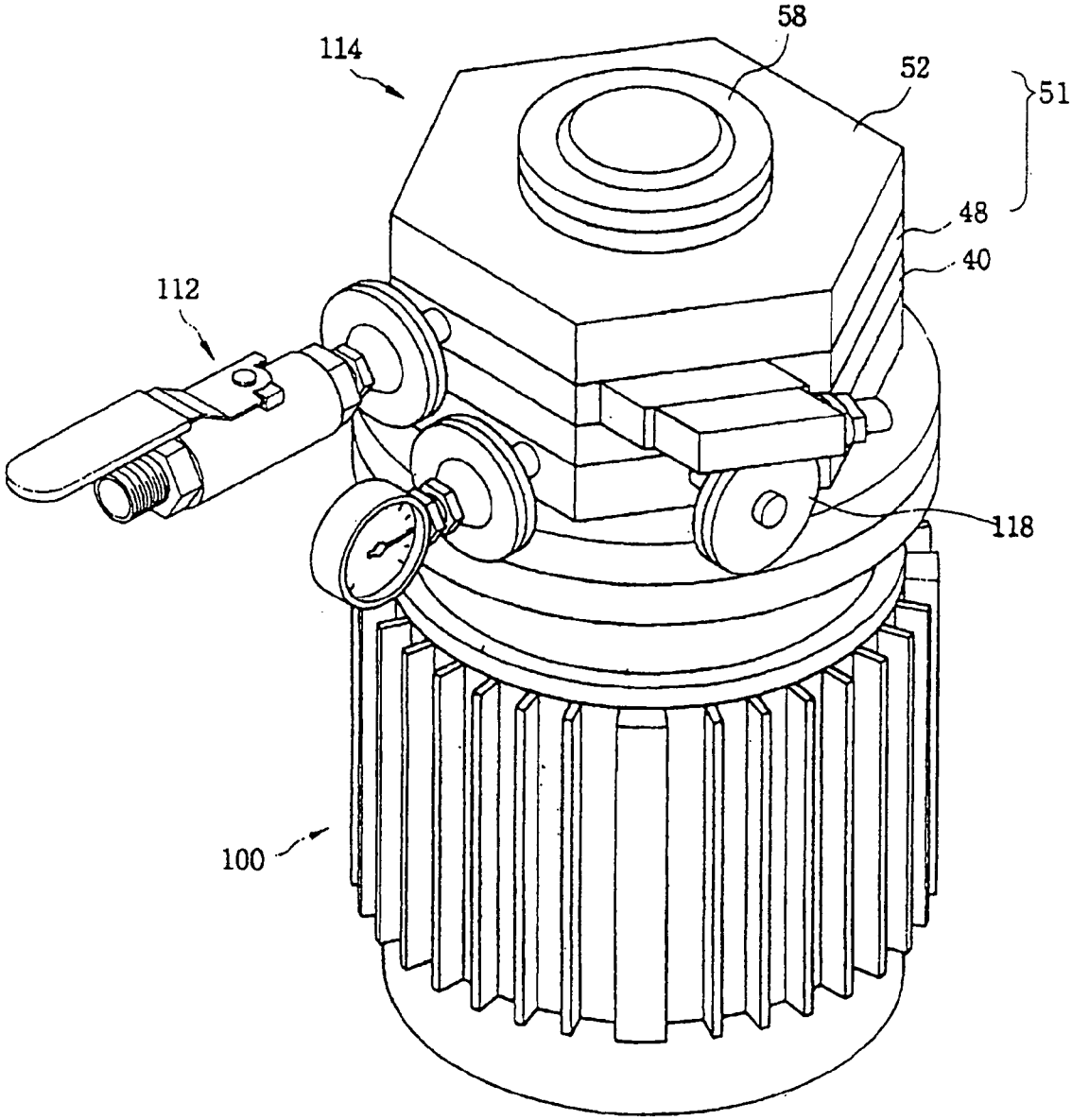
FIG. 1 is a perspective view of an embodiment of a mixing apparatus according to the invention.

A preferred embodiment of the invention will be described in detail below by referring to the accompanying drawings. Referring to FIG. 1 to FIG. 4, the mixing apparatus of the invention comprises a motor 100 having a shaft 102, a multi-layed mixing units 104, 106 having a rotation unit 104 fixed at the shaft 102 of the motor 100 and a fixing unit 106 fixed in a housing 114, and a housing 114 which accommodates the mixing units 104, 106.

Figure 2:
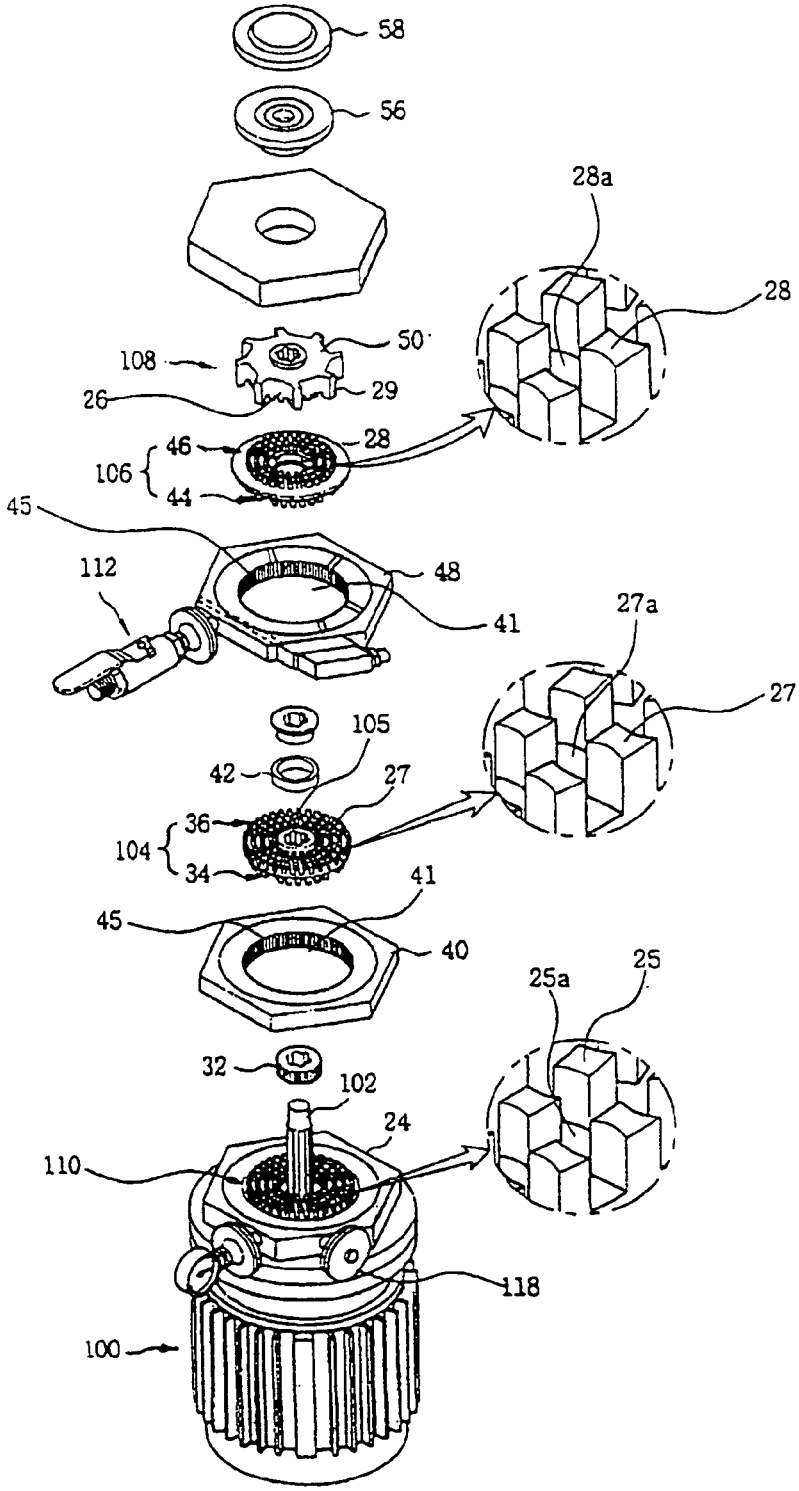
FIG. 2 is an exploded perspective view of FIG. 2.
Figure 3:
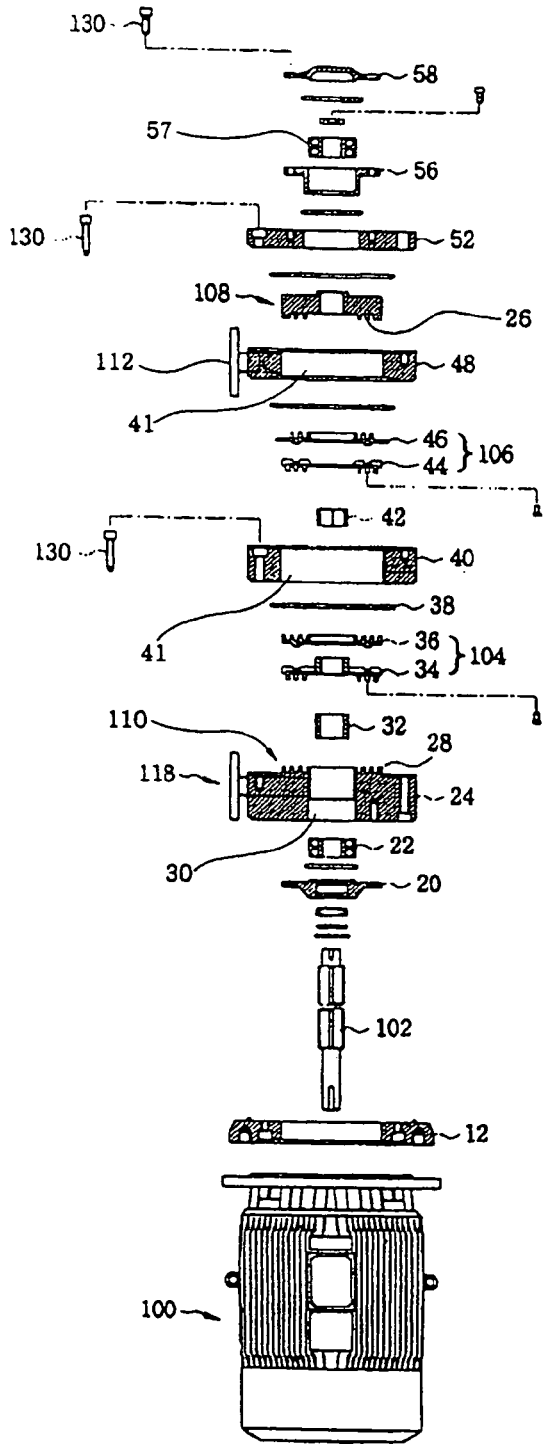
FIG. 3 is a dissembled sectional side view of FIG. 1.

The housing 114, as shown in FIG. 1 to FIG. 3, includes a lower housing 24 which is fixed on the flange of the motor 100 and has an inlet 118 supplying the fluid to the center of the housing 114, an intermediate housing 40 which is mounted on the lower housing 24 and has a mixing space 41 accommodating the mixing units 104, 106, and an upper housing 51 which is mounted on the intermediate housing 40 and has an outlet 112 discharging the fluid to the outside.

A shaft hole 30 to insert the shaft 102 is formed at the center of the lower housing 24, and a lower disk member 110 having a plurality of projections 25 of concentric circle shape is fixed at the central upper surface of the periphery of the shaft hole 30. And, an inlet 118 is formed at the inside of the lower housing 24 and the inlet 118 is opened to the center of the lower disk member 110.

The intermediate housing 40 is fixed on the lower housing 24 by a plurality of bolts 130, and a mixing space 41 to accommodate the mixing units 104, 106 is formed in the intermediate housing 40. And, a plurality of slots 45 parallel to the shaft 102 are formed at the inner wall of the mixing space 41. The intermediate housing 40 may be additionally added up according as the mixing units 104, 106 is added up.

The upper housing 51 is fixed on the intermediate housing 40 by a plurality of bolts 130, and includes a discharge block 48 having an outlet 112 which discharges emulsified or mixed material to the outside and a cover block 52 which is fixed on the discharge block 48. The shape of the discharge block 48 is similar to that of the intermediate housing 40, and a mixing space 41 to accommodate an upper disk member 108 is formed at the center of the discharge block 48. And, a plurality of slots 45 are formed at the inner wall of the mixing space 41. The cover block 52 is fixed on the discharge block 48 in order to seal the mixing space 41. A bearing 57 inserted into a ring body 56 is mounted at the center of the cover block 52 in order to support the shaft 102 of the motor 100 and a cap 58 is mounted on the upper end of the ring body 56.

The mixing units 104, 106 crushes the supplied fluids and mixes them, and it is composed of a rotation unit 104 and a fixing unit 106 which are alternately layered. Of course, any structures which are relatively rotated may be used besides the rotation unit 104 and the fixing unit 106.

Here, the arrays of the respective projections 27, 28 are formed at the facing side of the mixing units 104, 106 and they are located alternately in order to form concentric circles which are not interfered each other. The projections 27, 28 are arrayed along the circumferential direction of the concentric circles in a predetermined space so that the spaces 27*a*, 28*a* are formed between the projections 27, 28 and the fluid passes the spaces 27*a*, 28*a*. And, the both sides of the respective projections 27, 28 are formed with concave curve surface of arc shape. Accordingly, the fluids passing the spaces 27*a*, 28*a* between the projections 27, 28 and the projections 28, 27 collides with the respective projections 27, 28 so that they are crushed and mixed. At the same time the fluids are rotated along the concave curve surface of the respective projections 27, 28 at a high speed so that the efficiency of crushing and mixing may be increased by the collision between the crushed particles.

Figure 4:
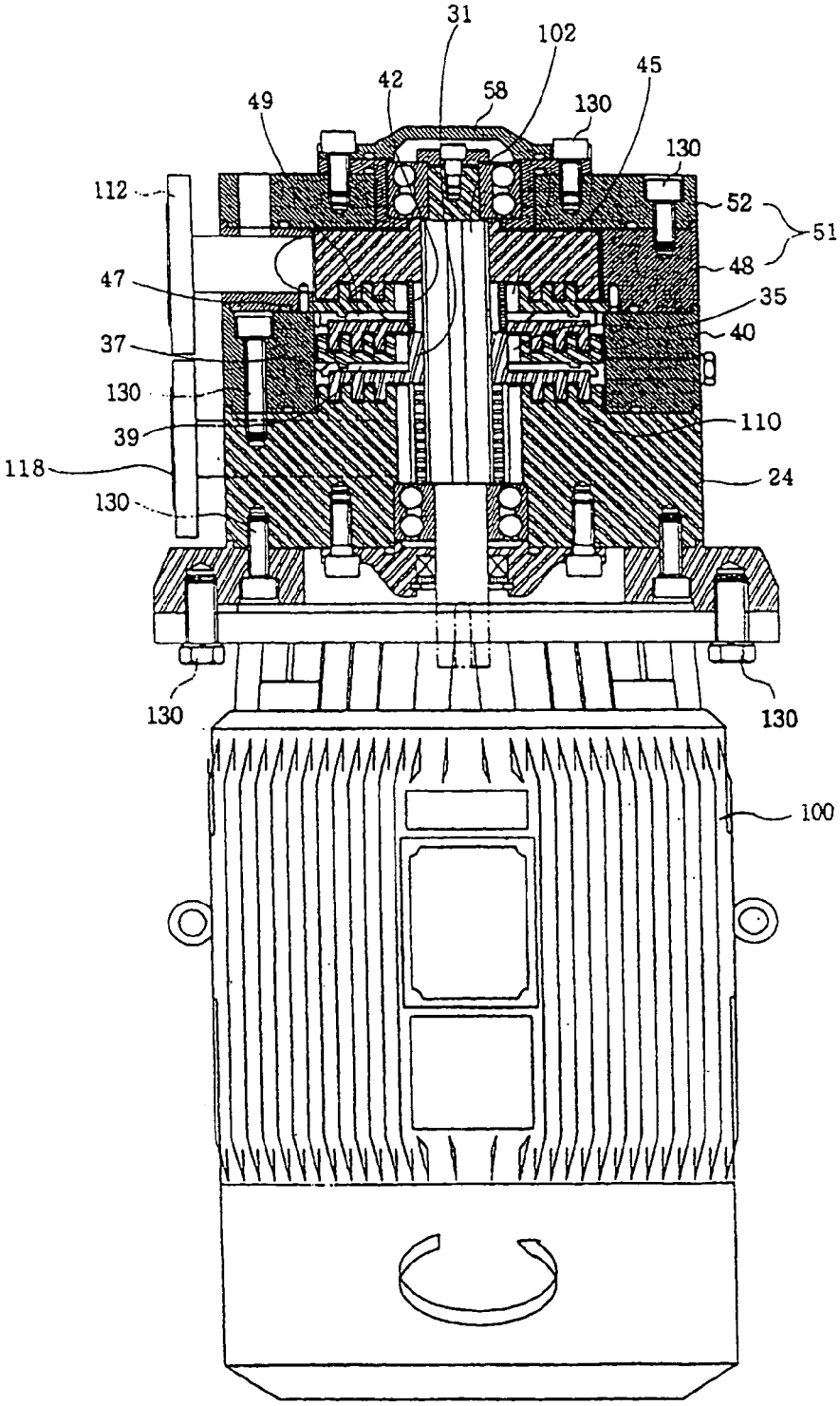
FIG. 4 is an assembled sectional side view of FIG. 1.
Figure 5:
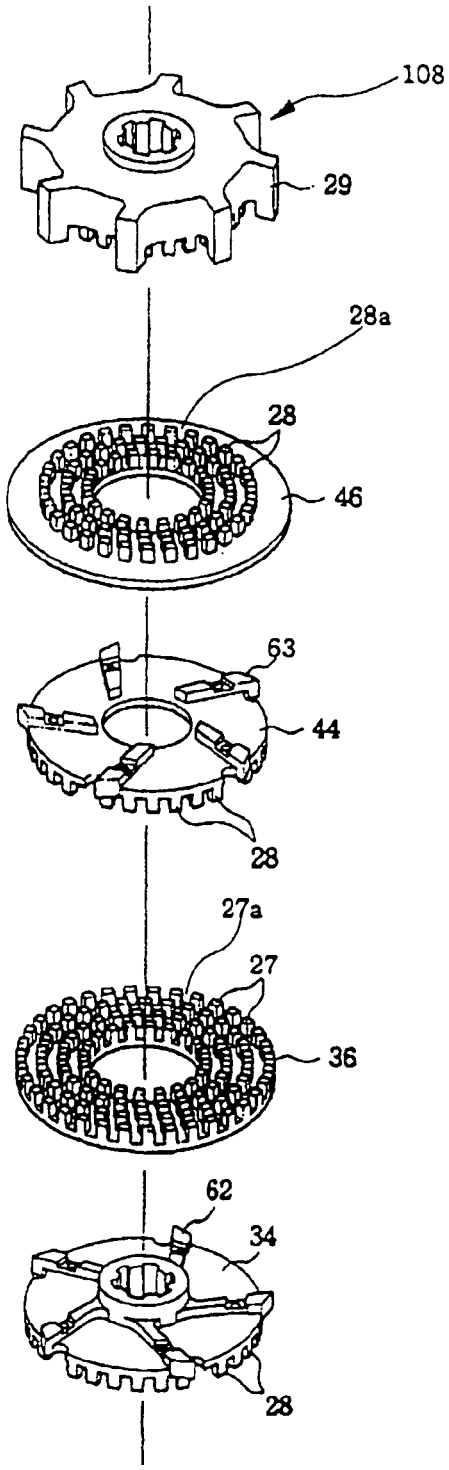
FIG. 5 is an exploded perspective view of a mixing units comprising the invention.
Figure 6:
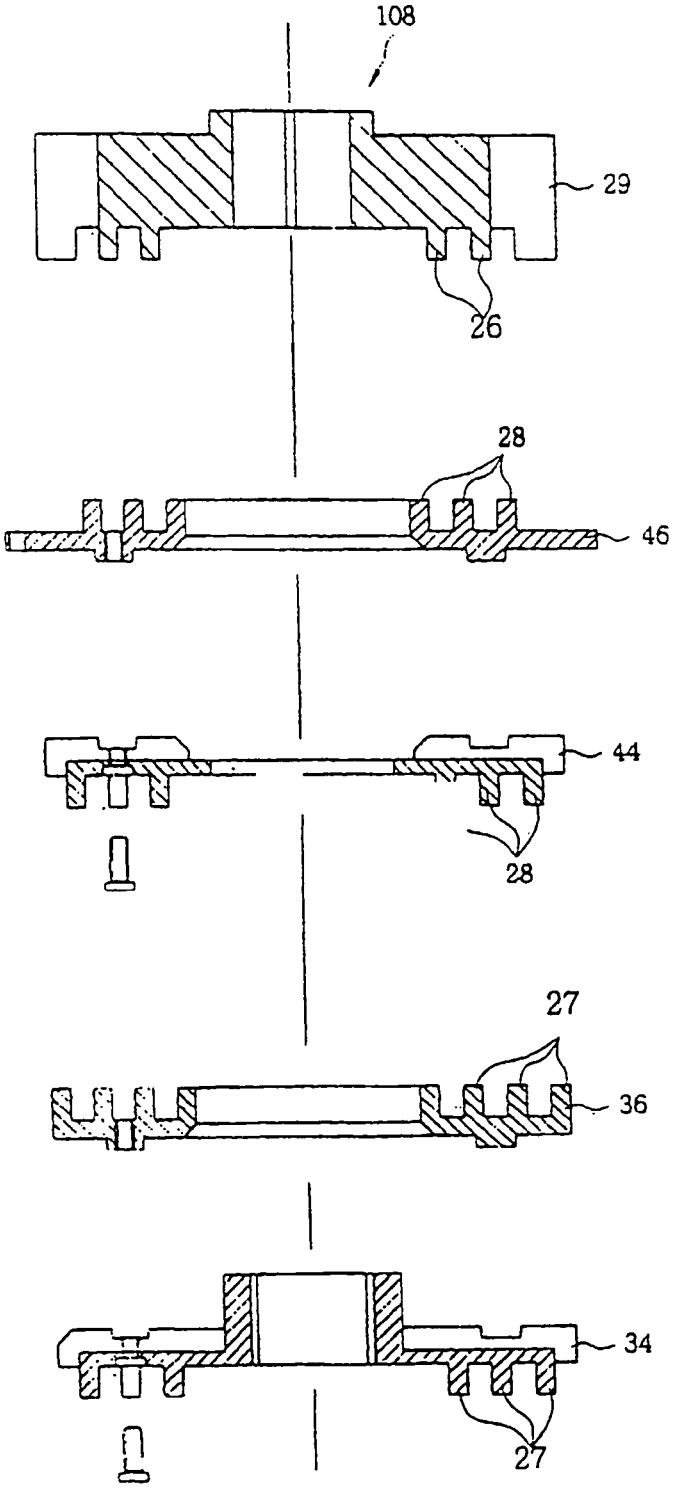
FIG. 6 is a dissembled sectional side view of FIG. 5
Figure 7:
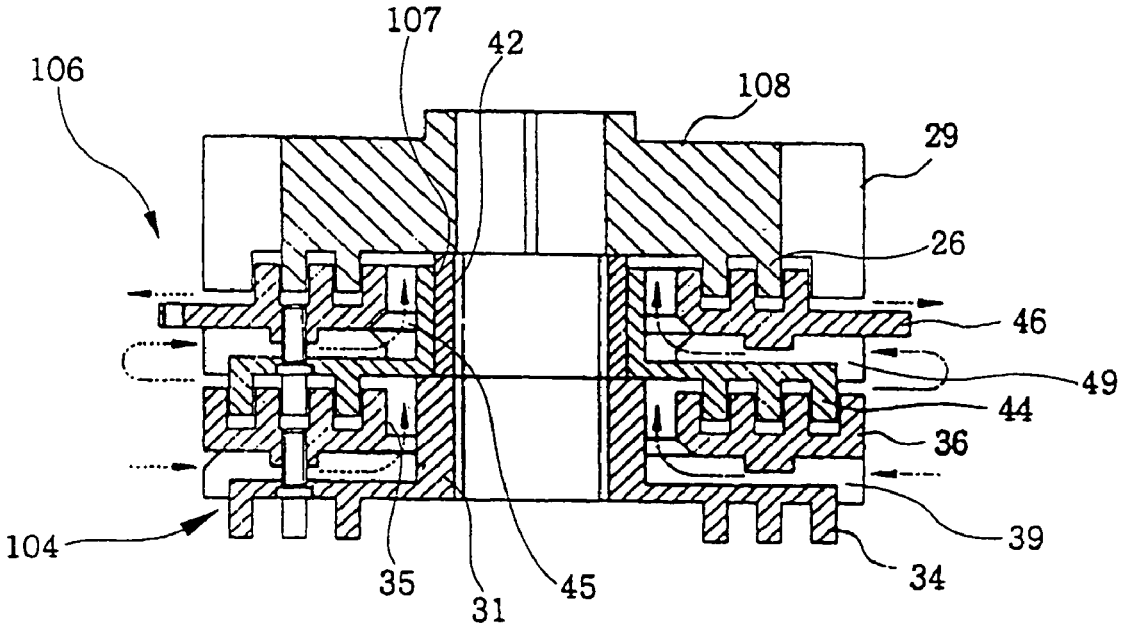
FIG. 7 is an assembled sectional side view of FIG. 5 showing the flow of the fluid.
Figure 8:
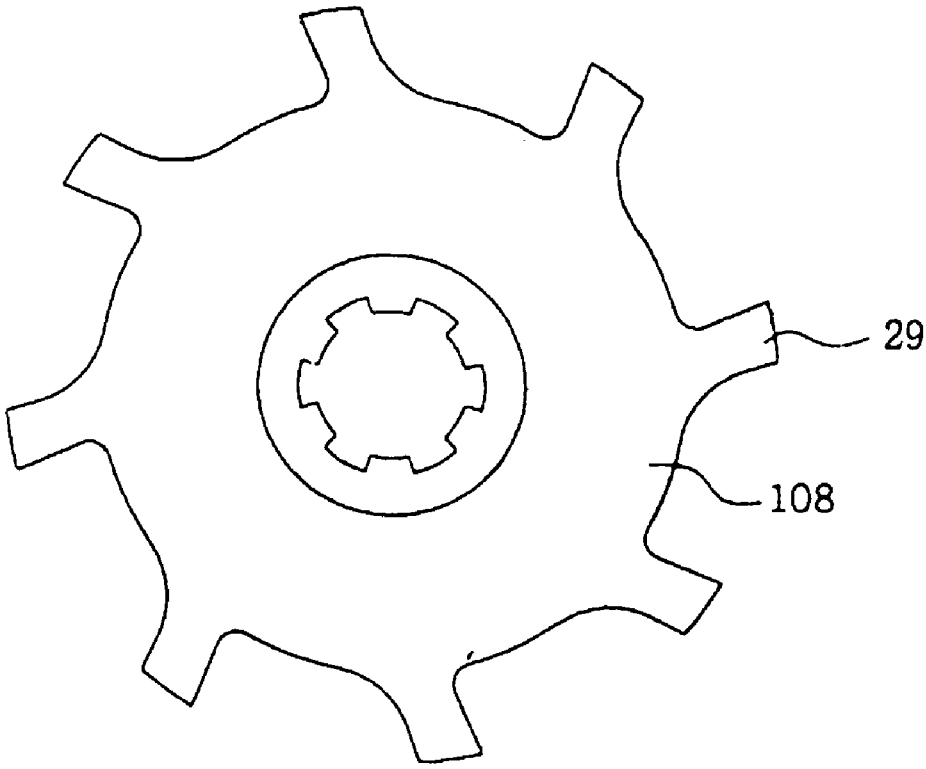
FIG. 8 is a plan view of an upper disk member comprising the invention.
Figure 9:
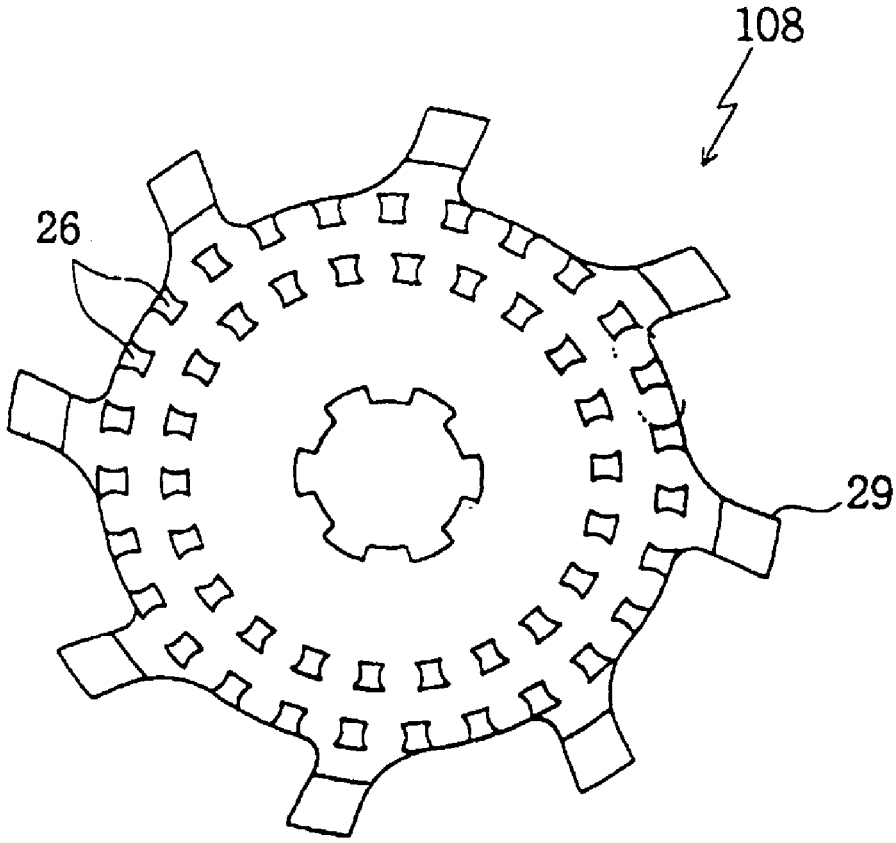
FIG. 9 is a bottom view of FIG. 9.
Figure 10:
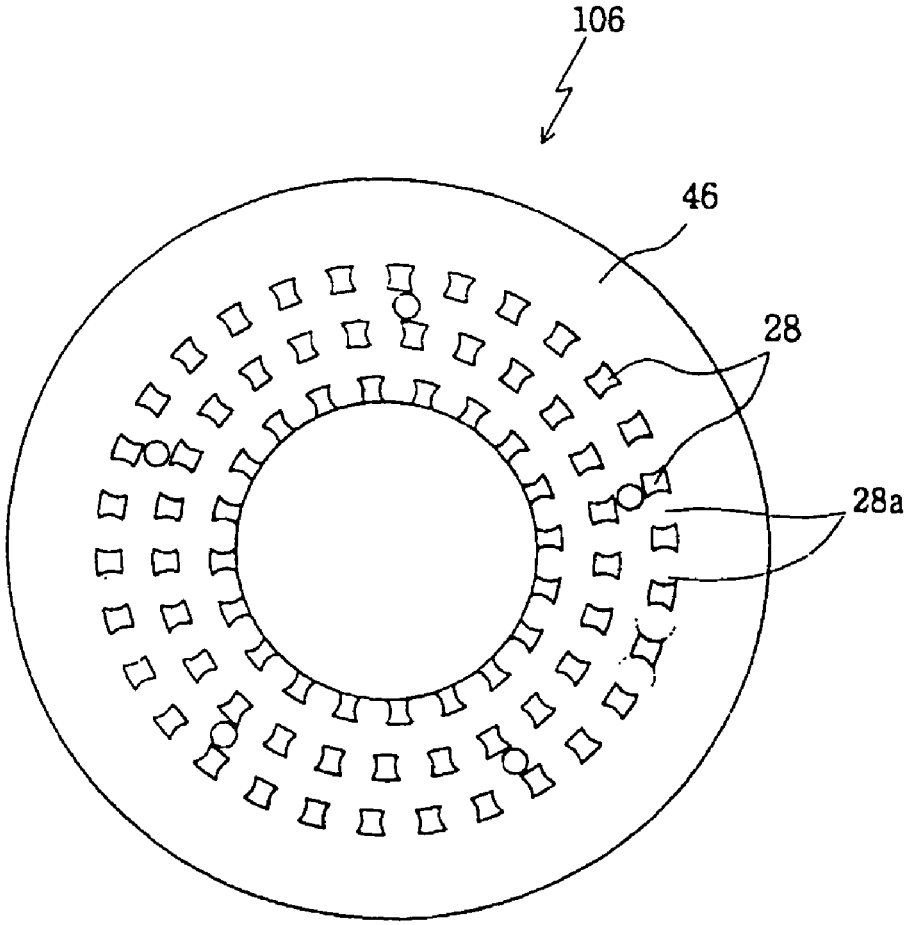
FIG. 10 is a plan view of an upper disk member comprising a fixing unit of the invention.
Figure 11:
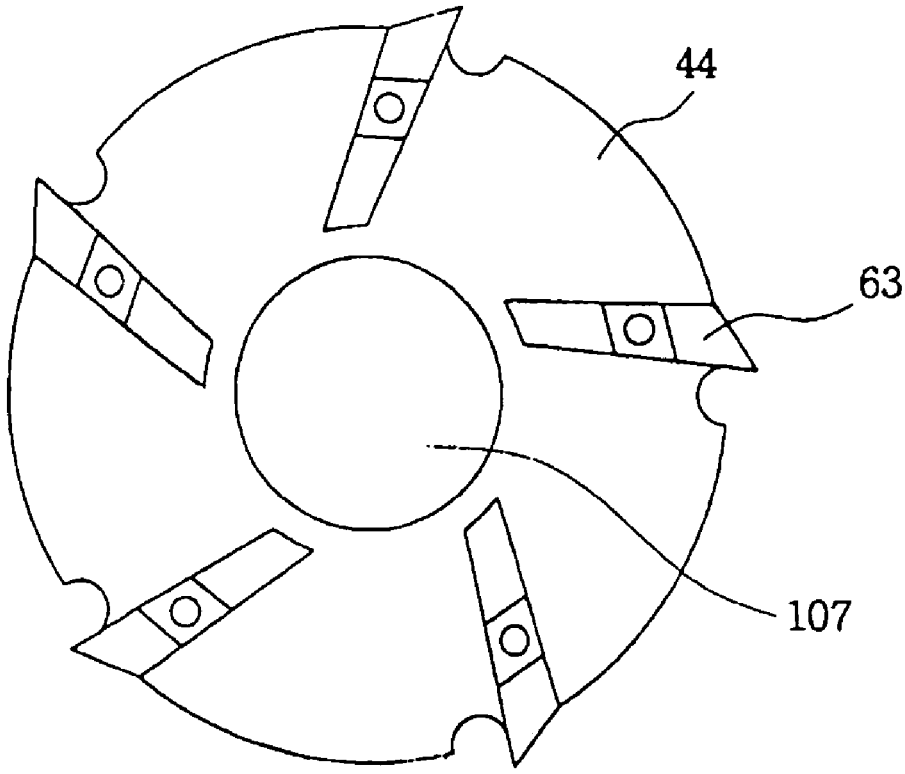
FIG. 11 is a bottom view of a lower disk member comprising said fixing unit.
Figure 12:
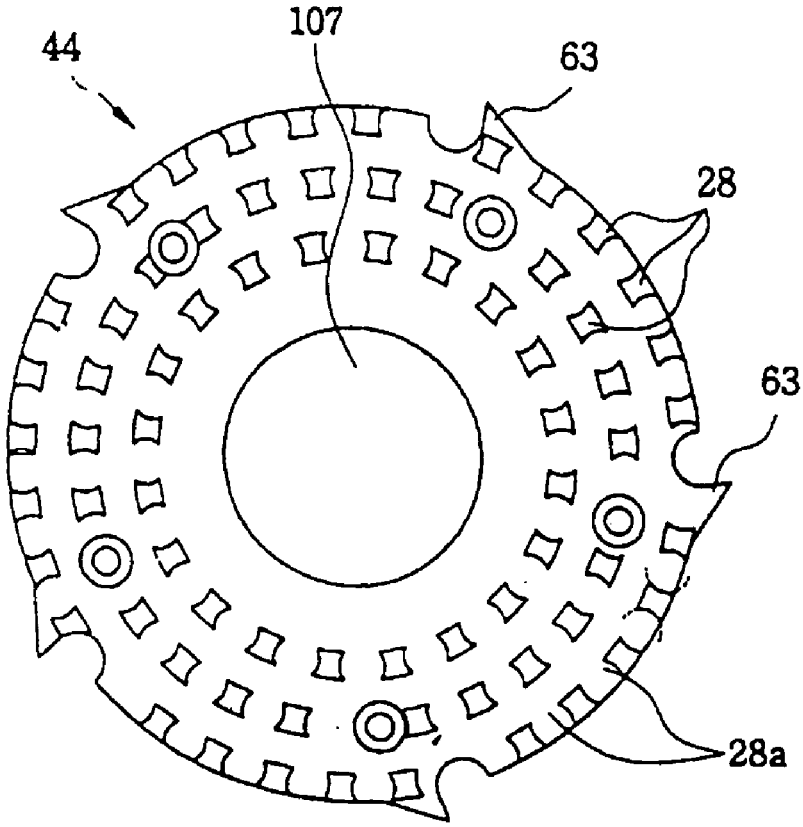
FIG. 12 is a bottom view of FIG. 11.
Figure 13:
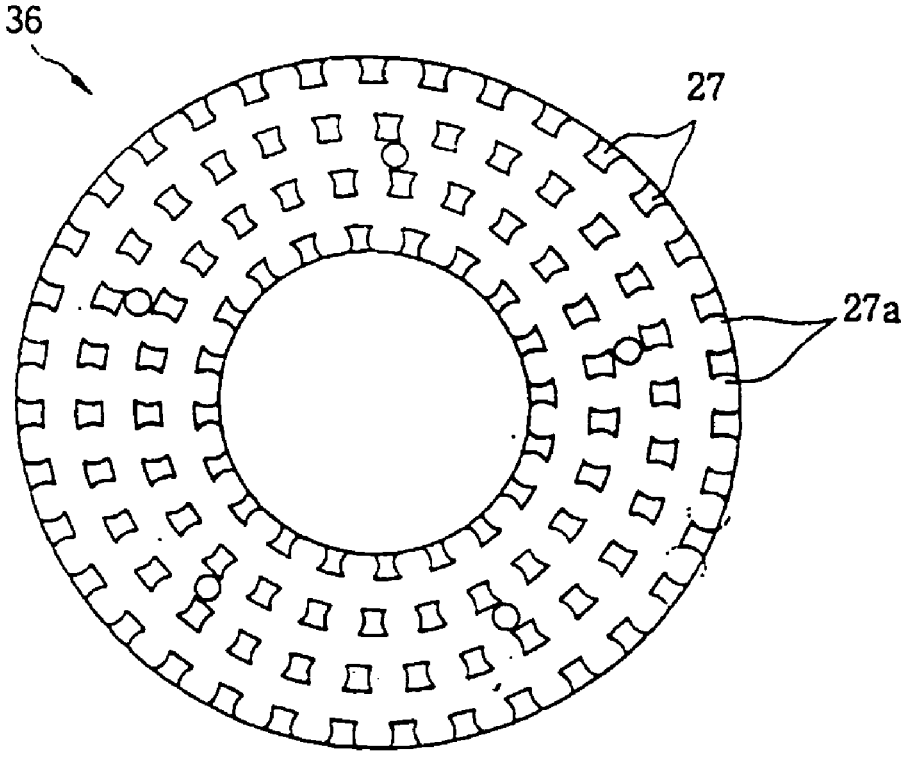
FIG. 13 is a plan view of an upper disk member comprising a rotation unit of the invention.
Figure 14:
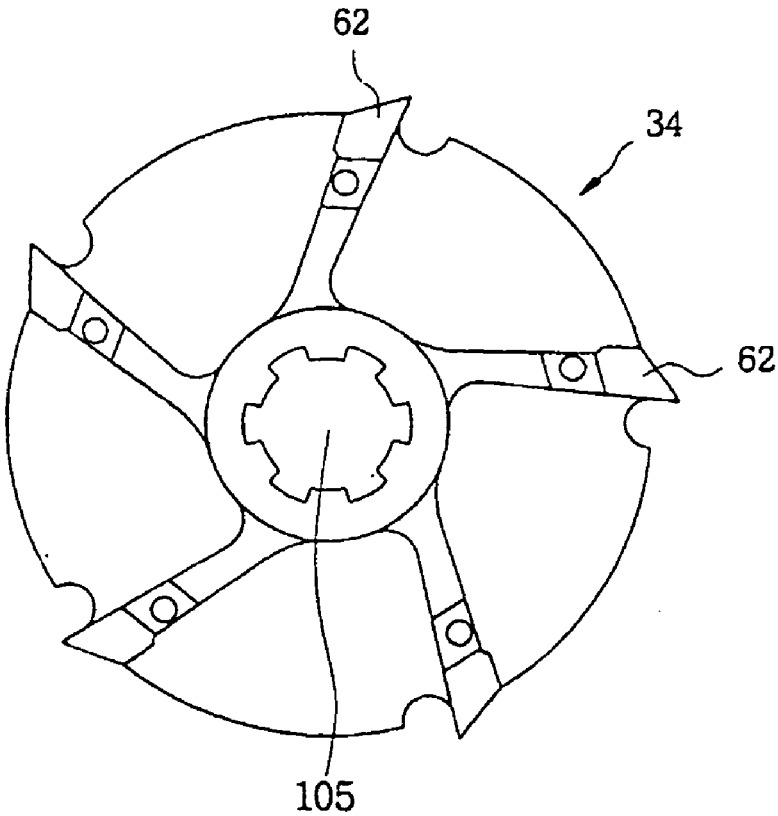
FIG. 14 is a plan view of a lower disk member comprising said rotation unit.
Figure 15:
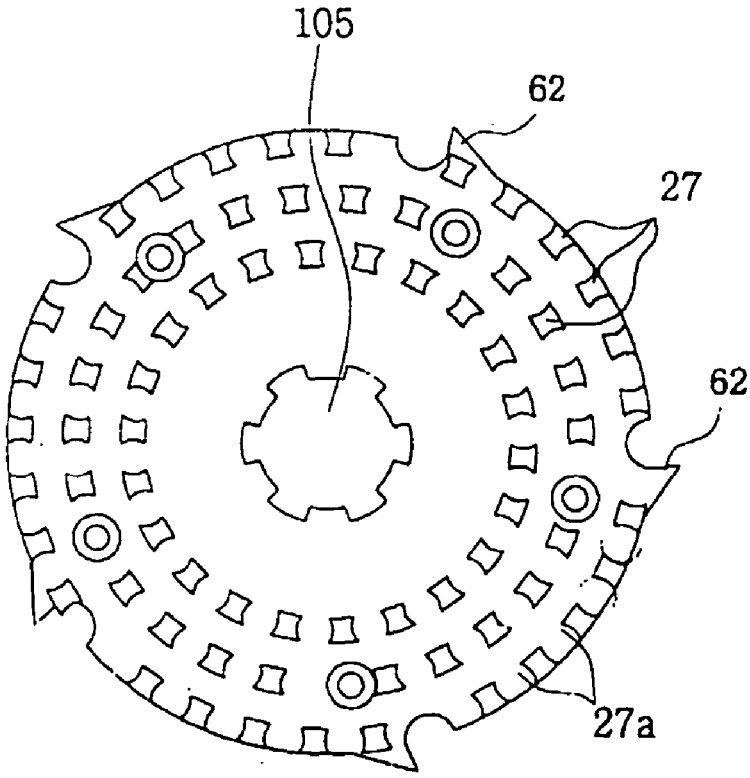
FIG. 15 is a bottom view of FIG. 14.
Figure 16:
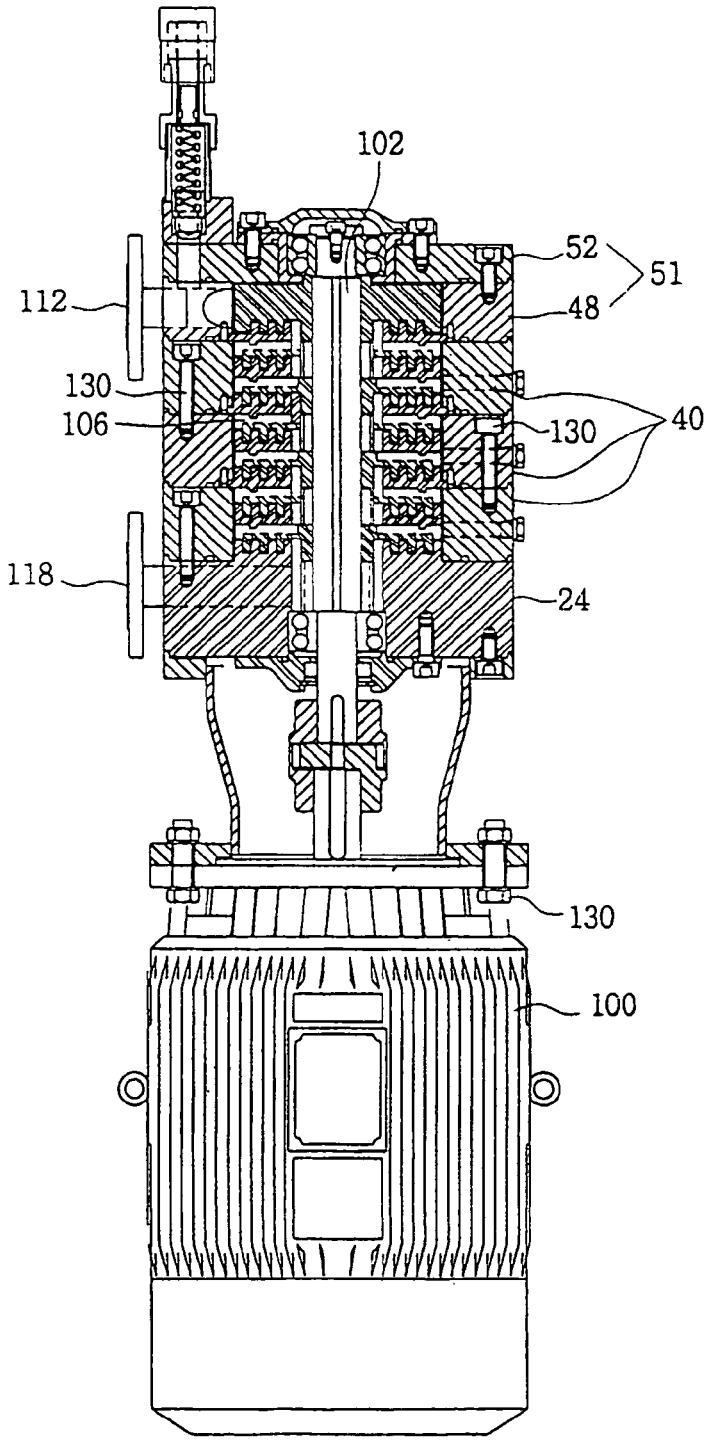
FIG. 16 is an assembled sectional side view of another embodiment of the invention.

And, the respective mixing units 104, 106, as shown in FIG. 5 and FIG. 7, are formed with a pair of disks 34, 36, 44, 46 which are spaced by the intermediate fluid guide blades 62, 63 at a predetermined space. Fluid passages are formed between the disks 34, 36, 44, 46 and the arrays of a plurality of projections 27, 28 are formed at the outer periphery of the respective disks 34, 36, 44, 46. The arrays of the projections 27, 28 are formed with concentric circle shape and the arrays of the projections 27, 28 are alternately engaged with the adjacent arrays of the projections 28, 27. And, among the disks 34, 36, 44, 46, the diameter of the disks 34, 44 directed to the inlet 118 of the housing 114, as shown in FIG. 4, is smaller than that of the housing 114 or the diameter of the housing is larger than that of said disks 34, 44. Accordingly, a predetermined space is formed between the outer periphery of said disks 34, 44 and the inner wall of the housing 114 so that inflow holes 37, 47 opened to the fluid passages 39, 49 are formed between the disks 34, 44 and the housing 114. And, the disks 114 directed to the outlet 112 of said housing 114 have exhaust holes 35, 45 which are opened to said fluid passages 39, 49.

Further, a boss 31 is mounted at the center of said rotation unit 104 and the boss 31 is combined with the shaft 102 of the motor 100 by spline. And, among the disks 44, 46 of the fixing unit 106, as shown in FIG. 2 and FIG. 7, the diameter of one disk 44 is larger than that of the mixing space 41 ant the periphery of said disk 44 is inserted into the connection portion of the housing 114 which are piled up in multiple layers so that the disk 44 is fixed in the housing.

And, as shown in FIG. 5 and FIG. 7, a plurality of fluid guide blades 62 are mounted at the fluid passage 39 in the rotation unit 104, and they are slanted to the rotation direction of the rotation unit 104 toward radial outer side. And, a plurality of fluid guide blades 63 are mounted at the fluid passage 49 of the fixing unit 106, and they are slanted to the direction which is opposite to the rotation direction of the rotation unit 104 toward the outer side of the radial direction. Accordingly, the fluid passing the respective fluid passages 39, 49 is guided by the fluid guide blades 62, 63 and flows toward the inner side of the diametric direction.

The mixing units 104, 106, may be additionally attachable in multiple layers. As shown in FIG. 2, an upper disk member 108 is mounted on the fixing unit 106. The upper disk member 108 is engaged with the fixing unit 106 and crushes the fluid to particles and mixes it. The upper disk member 108 is fixed at the shaft 102 of the motor 100 by spline and is rotated with the shaft 102. The arrays of the projections 26 are formed at the lower surface of the upper disk member 108, and they are alternately engaged with the arrays of the projections 28 of the fixing unit 106. A plurality of blades 29 are mounted at the periphery of the upper disk member 108, and they discharges the emulsified or mixed material to the outside through the outlet 112 of the upper housing 51.

As shown in FIG. 2 and FIG. 3, a base cover block 12 is fixed on the flange 10 of the motor 100 by a plurality of bolts, and the lower housing 24 is fixed on the base cover block 12. A bearing cover 20 is mounted in the inner side of the base cover block 12. A bearing 22 and a sleeve 32 are mounted in the shaft hole 30 of the lower housing 24 sequently. Here, the sleeve 32 is mounted at the shaft 102 of the motor 100, and a plurality of teeth are formed at the outer periphery of the sleeve 32 so that various fluids supplied through the inlet 118 of the lower housing 24 may be firstly crushed to particles and mixed by the sleeve 32.

And, the rotation unit 104 is mounted on the lower housing 24, and the arrays of the projections 28 formed at the lower surface of the rotation unit 104 are alternately engaged with the arrays of the projections 27 formed at the upper surface of the lower housing 24. Accordingly, the rotation unit 104 is rotated with the shaft 102 so that it crushes the supplied fluid to fine particles and mixes the particles.

The fixing unit 106 is mounted on the rotation unit 104, and the arrays of the projections 27 formed at the lower surface of the fixing unit 106 are alternately engaged with the arrays of the projections 28 formed on the upper surface of the rotation unit 104. And, as shown in FIG. 7, an insertion hole 104 is formed in the center of the lower disk 44 of the fixing unit 106, and a sleeve 42 is inserted into the insertion hole 107. The sleeve 42 is slidably combined at the periphery of the shaft 102. Accordingly, the sleeve 42 keeps the space between the fixing unit 106 and the rotation unit 104 so that the shaft 102 may be rotated smoothly and the fluid does not flow backward toward the lower direction through the insertion hole 107.

The rotation unit 104 and the fixing unit 106 are alternately piled up in multiple layers. And, the upper disk member 108 is mounted on the upper fixing block 106 and it is fixed at the periphery of the shaft 102. Here, the arrays of the projections 26 of the upper disk member 108 are alternately engaged with the arrays of the projections 28 of the upper fixing block 106.

According to the invention, as shown in FIG. 2 and FIG. 4, the fluid supplied through the inlet 118 of the lower housing 24 passes the insertion hole 30 so that it is preliminarily crushed to fine particles and mixed by the teeth of the sleeve 32 which is rotated with the shaft 102. And, the crushed and mixed fluid is supplied between the lower disk member 110 and the rotation unit 104.

Next, said fluid is rotated along the rotation unit 104, and it alternately passes the arrays of the projections 25 of the lower disk member 110 and the arrays of the projections 27 of the rotation unit 104 owing to the centrifugal force. At this time, the fluid repeats the rotation movement(so to speak, the movement which is rotated along the rotation direction of the rotation unit 104) by the arrays of the projections 27 of the rotation unit 104 and the suspension of the rotation movement by the arrays of the projections 25 of the lower disk member 110 so that it is crushed and mixed. At the same time, the fluid is rotated in the spaces 25*a*, 27*a* between the respective projections 25, 27(so to speak, it is rotated along the wall of the projections 25, 27 arrayed in the spaces 25*a*, 27*a* between the respective projections 25, 27) so that it is crushed to fine particles and mixed owing to the collision between the particles.

Like the above, the fluid which passed between the lower disk member 110 and the rotation unit 104, as shown in FIG. 7, flows in the fluid passage 39 between the lower and the upper disks 34, 36 of the rotation unit 104 and is supplied between the rotation unit 104 and the fixing unit 106 through the outflow hole 35 of the center of the upper disk 36. Here, the fluid guide blades 62 of FIG. 5 are mounted in the fluid passage 39 of the rotation unit 104 so that the fluid supplied to the periphery of the rotation unit 104 flows in the inner side of the rotation unit 104 by the fluid guide blades 62. In the end, the supplied fluid is smoothly flown by the fluid guide blades 62.

Next, the fluid supplied between the rotation unit 104 and the fixing unit 106 flows toward the outer periphery through the respective arrays of the projections 27, 28 of the rotation unit 104 and the fixing unit 106 according as the rotation unit 104 is rotated at a high speed. And, the fluid which flows toward the outer periphery is crushed in particles and mixed uniformly in the same method as the fluid is crushed and mixed between the lower disk member 110 and the rotation unit 104. In the result, the fluid is emulsified in more fine particles.

Accordingly, the mixing apparatus of the invention emulsifies the fluid to fine particles of desirous size by repeating the above procedures by means of multi-layed mixing block 104, 106 and supplies the emulsified fluid to various apparatus(for example, a boiler or a ship engine) which are connected to its outlet 112.

The mixing apparatus of the invention may emulsify the fluid of desirous size and supply the emulsified fluid to the apparatus connected to it because the mixing block 104, 106 may be additionally attachable whenever the user may add up a plurality of the intermediate housing 40 between the upper housing 24 and the lower housing 51 of FIG. 2 and exchange the shaft 102 for the shaft 102 of the corresponding length. According to the mixing apparatus of the invention, the static emulsification material which is not separated into different substance may be supplied to the apparatus connected to the mixing apparatus, and a plurality of mixing machines are not required in order to make emulsification material of desirous size. And, the mixing apparatus of the invention does not require additional equipments like a tank for storing the emulsified material for some time.

And, according to the mixing apparatus of the invention, the fluid filled in the spaces 27*a* of the respective projections 27 of the rotation unit 104 is rotated in a predetermined angle and flows toward the spaces 28*a* between the respective projections 28 of the fixing unit 106. Here, the both sides of the projection 27, 28 is formed with concave curve surface, and the end of the inlet side approximately corresponds to the direction where the fluid is flown by centrifugal force. Therefore, because the fluid supplied in the space 27*a*, 28*a* is not resisted in its acceleration movement and is rotated along the concave curve surface of the projections 27, 28 at a high speed, and the collision between the crushed particles may be increased so that the efficiency of crushing and mixing may be increased remarkably.

Like the above, the mixing apparatus has advantage that no emulsifier for stabilizing the emulsified material is not required additionally, the cost may be decrease, and environment pollution is not caused at all.

Besides, the respective projections 27, 28 is made by drilling the ring-shaped protrusions formed on one side of the respective disks 34, 36, 44, 46 in a predetermined space. Accordingly, the mixing apparatus may increase the efficiency of crushing and mixing the fluid because the size of the projections 27, 28 are formed uniformly although the respective mixing units 104, 106 is enlarged. And, the capacity of the mixing apparatus may be easily increased and a great amount of the fluid may be emulsified into desirous size and supplied to the machines connected to it.

And, according to the mixing apparatus, the fluid guide blades 62, 63 are mounted in the respective mixing units 104, 106 and they guide the fluid discharged to the periphery of the mixing units 104, 106 into the center of the mixing units 104, 106. Therefore, although the capacity of the mixing units 104, 106 is increased, the fluid passing the mixing units 104, 106 may flow smoothly.

The mixing apparatus may crush and mix a powder material as well as the fluid. The mixing apparatus may be applied to the chemical goods like adhesives, paint, grease, insecticide, herbicide, liquid fertilizer, the foods like nectar, fruit juice, vegetable juice, edible solid, the cosmetic like lotion, cream, gel, lip stick, toothpaste, and the industrial field utilizing oil. Besides, the mixing apparatus may be applied to the various fields.

Accordingly, the mixing apparatus of the invention has the advantages that raw material may be crush to fine particles of desirous size and mixed uniformly by means of multi-layed mixing blocks which are attachable additionally and the emulsified material is supplied to the connected machine, the cost may be decreased because no emulsifier is required additionally, the efficiency of crushing and mixing may be increased because the movement of raw material is increased, and a great amount of raw material may be crushed and mixed uniformly because the capacity may be increased easily.

The invention claimed is:

1. A mixing apparatus comprising a plurality of mixing units piled up in a housing having an inlet, a mixing space and an outlet, the mixing units are relatively rotated by a motor, and have arrays of projections formed and arrayed along the circumferential direction in a predetermined space, the arrays of the projections located alternately in order to form concentric circles not interfered with each other;

wherein said respective mixing units are formed with first and second pairs of upper and lower disks which are parallel arrayed in a predetermined space, the arrays of the projections are formed on the outer surface of the pairs of disks, fluid passages are formed between the upper and lower disks of each pair, a predetermined space is formed between the outer surface of the lower disks of each pair directed to the inlet of the housing and inner surface of the housing so that inflow passages opening to the fluid passages are formed between the lower disks and the housing, outflow passages opening to the fluid passages are formed at the inner surface of the upper disks of each pair directed to the outlet of the housing, and the mixing units are attachable in multiple layers;

wherein both sides of the projections of said mixing units are formed with concave curve surfaces;

wherein the surfaces are concave in the direction of the plane of the mixing units and are curved such that the concave curve surfaces form a curved fluid path in at least the direction of fluid flow;

wherein a plurality of mixing units are divided into a rotation unit and a fixing unit, a combination hole is formed at the center of the rotation unit, a shaft of the motor is inserted into the combination hole, the fixing unit is fixed to the inner surface of the housing, and an insertion hole is formed at the center of the fixing unit and the shaft is slidably combined in the insertion hole.

2. A mixing apparatus of claim 1 wherein the housing includes lower housing having an inlet to supply the fluid into the center of the mixing units, one or more of intermediate housings connected to the lower housing and having the mixing space to accommodate the mixing units, and an upper housing connected to the intermediate housing and having an outlet which is opened to the mixing space of the intermediate housing, wherein the intermediate housing comprising a plurality of attachable multiple layers.

3. A mixing apparatus of claim 1, comprising one or more of fluid guide blades which are slanted radially are mounted at the fluid passage in the rotation unit, one or more of fluid guide blades slanted to the direction which is opposite to that of the fluid guide blades are mounted at the fluid passage of the fixing unit, and the fluid which passes the fluid passages may be guided to flow in the inner side by said fluid guide blades.

4. A mixing apparatus of claim 1 wherein a plurality of slots parallel to a shaft are formed at the inner circular surface of the mixing space of the housing.

5. A mixing apparatus of claim 1 wherein disk members having the arrays of a plurality of projections at one side are mounted in the inner space between the inlet side and the outlet side of the housing, the arrays of the projections are located alternately with the arrays of the projections of the adjacent mixing units, and the disk members and the mixing units are relatively rotated.

* * * * *